US008469686B2

(12) United States Patent
Stündl et al.

(10) Patent No.: US 8,469,686 B2
(45) Date of Patent: Jun. 25, 2013

(54) APPARATUS FOR TREATING A MULTIFILAMENT THREAD

(75) Inventors: Mathias Stündl, Wedel (DE); Thomas Brandenstein, Hammelburg (DE)

(73) Assignee: Oerlikon Textile Components GmbH, Hammelburg (DE)

( * ) Notice: Subject to any disclaimer, the term of this patent is extended or adjusted under 35 U.S.C. 154(b) by 570 days.

(21) Appl. No.: 12/669,753

(22) PCT Filed: Jul. 3, 2008

(86) PCT No.: PCT/EP2008/058630

§ 371 (c)(1),
(2), (4) Date: Jun. 10, 2010

(87) PCT Pub. No.: WO2009/013107

PCT Pub. Date: Jan. 29, 2009

(65) Prior Publication Data

US 2010/0257710 A1 Oct. 14, 2010

(30) Foreign Application Priority Data

Jul. 25, 2007 (DE) ..... 10 2007 034 598

(51) Int. Cl.
*B29C 47/00* (2006.01)
*B29C 47/12* (2006.01)

(52) U.S. Cl.
USPC ..... 425/72.2; 425/66; 425/104; 425/378.2; 425/404; 264/103; 264/211.12; 264/567; 264/167

(58) Field of Classification Search
USPC 425/72.2, 66, 104, 404, 378.2, 446; 264/103, 264/211.12, 211.14, 167, 555, 557, 561; 118/420, 423, 428, 429
See application file for complete search history.

(56) References Cited

U.S. PATENT DOCUMENTS

| | | | | |
|---|---|---|---|---|
| 4,812,112 | A * | 3/1989 | Balk | 425/66 |
| 5,573,790 | A * | 11/1996 | Wehtje et al. | 425/404 |
| 6,834,417 | B1 | 12/2004 | Buchmüller | |
| 8,178,015 | B2 * | 5/2012 | Harris et al. | 264/103 |
| 8,246,898 | B2 * | 8/2012 | Conrad et al. | 264/555 |
| 2007/0138686 | A1 * | 6/2007 | Reutter et al. | 264/103 |

(Continued)

FOREIGN PATENT DOCUMENTS

| | | |
|---|---|---|
| DE | 101 50 357 | 4/2003 |
| DE | 10150356 A1 * | 4/2003 |
| WO | WO 03/033791 | 4/2003 |

OTHER PUBLICATIONS

International Preliminary Report on Patentability and Written Opinion for International Appl. No. PCT/EP2008/058630 issued Feb. 9, 2010.

(Continued)

*Primary Examiner* — Joseph S Del Sole
*Assistant Examiner* — Nahida Sultana
(74) *Attorney, Agent, or Firm* — Alston & Bird LLP

(57) ABSTRACT

The invention relates to an apparatus for treating a multifilament thread in a melt-spinning process, wherein a treatment channel is formed between a housing plate and an impact plate. The housing plate has a nozzle bore which opens into the treatment channel and is connected to a compressed-air connection. Together with the housing plate, the impact plate forms an inlet opening and an outlet opening at both ends of the treatment channel. In order to check the swirling effects which are produced on the thread by the eddying within the treatment channel, according to the invention the impact plate has a thread guiding element in the part piece of the treatment channel between the nozzle bore and the inlet opening, which thread guiding element is configured so as to protrude into the treatment channel in order to deflect the thread.

16 Claims, 5 Drawing Sheets

U.S. PATENT DOCUMENTS

| | | | | |
|---|---|---|---|---|
| 2007/0158485 | A1 | 7/2007 | Spahlinger et al. | |
| 2009/0026647 | A1* | 1/2009 | Geus et al. | 264/40.6 |
| 2010/0243764 | A1* | 9/2010 | Okesaku et al. | 239/589 |
| 2011/0018163 | A1* | 1/2011 | Casey et al. | 264/204 |
| 2011/0020628 | A1* | 1/2011 | Fukudome et al. | 428/221 |

OTHER PUBLICATIONS

International Search Report for International Application No. PCT/EP2008/058630.

* cited by examiner

APPARATUS FOR TREATING A MULTIFILAMENT THREAD

BACKGROUND OF THE INVENTION

1. Field of the Invention

The present invention relates to an apparatus for treating a multifilament thread in a melt-spinning process.

2. Description of Related Art

When producing synthetic threads, a plurality of fine filament strands is extruded from a polymer melt in a melt-spinning process and then combined to form a multifilament thread after cooling down. In order to enable the subsequent guidance of the thread in further treatment steps, for example, for drawing the thread with the aid of godets, it is necessary to wet the thread. For this purpose, a spin finish fluid is applied to the thread. In order to ensure that all the filament strands disposed in the thread are wetted uniformly, the thread is interlaced with the aid of a compressed-air blast in an additional treatment step following the wetting step. This interlacing process, in other words, the so-called "pre-entangling," results in a homogenized application of the spin finish fluid to the filament strands of the thread. At the same time, the filament strands are intermixed as a result of the interlacing process, which improves the cohesion of the filament strands disposed in the thread.

For carrying out the wetting and interlacing of the thread, an apparatus is disclosed in the prior art, for example, in EP 1 165 868 B1 or DE 10 2004 017210 A1, in which apparatus the treatment steps for wetting the thread and interlacing the same are carried out immediately one after the other in the thread path with a short interval in between. For this purpose, the devices for the application of spin finish fluid and the devices for interlacing the thread are disposed in a common housing. Immediately following the wetting process, the thread is guided with a spin finish fluid without further thread-guiding elements in a common treatment channel for subsequent interlacing. In this context, it is possible to achieve particularly compact apparatuses for treating a multifilament thread in several steps.

In the apparatus known from the prior art, it has now been observed that the interlacing of the filament strands within the thread produces dynamic effects that continue to act in the direction extending opposite to the thread path up to the wetting step and beyond the latter. However, such effects, which become particularly noticeable by way of twist effects appearing on the thread, can sometimes adversely affect the upstream treatment steps performed on the thread.

SUMMARY OF VARIOUS EMBODIMENTS

It is now the object of the present invention to develop an apparatus for treating a multifilament thread of the kind cited at the start in such a way that the dynamic effects produced by the interlacing process can be controlled for the upstream treatments carried out on the multifilament thread.

This object is achieved according to the invention by an apparatus of various embodiments.

Preferred developments of the invention are defined by the features and combinations of features of the respective dependent claims.

One particular advantage of the invention is that the dynamic effects, particularly the twist effects, produced on the thread by a compressed-air blast, cannot act on the thread uncontrollably in the direction extending opposite to the thread path. As a so-called twist stop, the baffle plate comprises a thread-guiding element in that portion of the treatment channel that is located between the nozzle bore and the inlet opening; this thread-guiding element is configured so as to protrude into the treatment channel in order to deflect the thread. The thread is thus subjected to a forced deflection, which results in a stabilization of the filament strands disposed within the thread composite. It is thus possible to advantageously avoid twist effects acting in the opposite direction.

The invention was also not suggested by the apparatus disclosed in WO 03/033791 A2 for treating a multifilament thread. The apparatus disclosed there comprises a treatment channel for interlacing a thread inside a housing plate; this treatment channel contains a projection in the groove ground on the inlet side and on the outlet side in each case. Thread guides are assigned to both the thread inlet and the thread outlet outside the treatment channel and these thread guides subject the thread to a desired forced guidance inside the treatment channel.

The apparatus disclosed in the document cited above is therefore completely unsuitable for enabling the implementation of several treatment steps on the thread one after the other at short intervals. Furthermore, the projections disposed in the groove ground of the housing plate are completely unsuitable for preventing possible twist effects from acting in the direction extending opposite to the travel direction of the thread. The compressed-air blast opening into the treatment channel from the nozzle bore thus results in a deflection of the thread against the baffle plate. Consequently, the thread is lifted off by the projections provided in the groove ground of the housing plate so that there remains no forced guidance of the thread inside the treatment channel. A twist effect produced by the compressed-air blast could thus act freely up to the thread guides disposed outside the housing plate in the known apparatus.

Another particular advantage of the invention is that irrespective of the deflection of the thread brought about by the compressed-air blast, the forced guidance remains inside the treatment channel due to the thread-guiding element. For this purpose, the thread-guiding element is disposed on the baffle plate located opposite to the housing plate. The deflection of the thread brought about by the compressed-air blast thus further enhances the deflection, for which the thread-guiding element is intended, in the direction of the groove ground of the treatment channel.

In order to be able to bring about a larger deflection on the thread particularly in the case of coarse yarn counts of the filament strands, that development of the invention is particularly advantageous in which the housing plate comprises a recess in the region of the thread-guiding element for extending the treatment channel, and the thread-guiding element can be inserted through the recess beyond a groove depth of the treatment channel. This also makes it possible to achieve larger deflections of the thread beyond the groove depth of the treatment channel. Furthermore, the recess in the groove ground enables the implementation of additional points of support on the thread guided in the treatment channel so that particularly strong twist effects can also be stopped.

In a preferred development of the invention, the thread-guiding element is formed by a molded projection on the baffle plate; this projection comprises a wear-resistant contact surface in relation to the thread. The thread-guiding elements and the baffle plate can thus be advantageously produced from the same material.

For achieving variably large deflections, the baffle plate is preferably connected to the housing plate such that the former can be replaced, it being possible to selectively combine several baffle plates having variably high projections with the housing plate. The desired twist-stopping effects can be achieved depending on the thread type and the melt-spinning process. This development of the invention enables a high degree of flexibility to be achieved in the interlacing of the thread.

However, it is likewise possible in principle, to form the thread-guiding element by a thread guide, which is held at the baffle plate such that the thread guide can be replaced. Here, the thread guide can be formed by a deflection pin or a deflection roller, the contact surfaces of which have a wear-resistant coating in relation to the thread. It is thus possible to advantageously produce the thread-guiding element and the baffle plate from different materials.

The preferred development of the invention, in which the housing plate comprises an assembly opening for connection to a wetting device in that portion of the treatment channel that is located between the thread-guiding element and the inlet opening provides a very compact design in order to be able to carry out both a wetting of the thread and an interlacing of the thread inside the treatment channel. For this purpose, a wetting element for applying spin finish fluid to the thread is held inside the assembly opening of the housing plate and this wetting element protrudes into the treatment channel.

In order to ensure flexibility in using the apparatus for different processes and thread types, the wetting element according to a preferred development of the invention is preferably connected to the housing plate such that the former can be replaced. Wetting elements adapted to suit the yarn counts of the thread can thus be integrated easily in the housing plate.

Preferably, spin finish applicators comprising a ceramic contact surface in the guide area of the thread are used as wetting elements. The spin finish fluid is preferably guided via a capillary bore toward the contact surface so that the thread can be wetted continuously.

It has been observed that the interlacing process, following the wetting process immediately, spins off a part of the spin finish fluid from the thread and this fluid accumulates inside the treatment channel. In order to prevent losses of the spin finish fluid, that development of the invention is preferred in which the housing plate comprises a collector opening in that portion of the treatment channel that is located between the nozzle bore and the outlet opening. This collector opening opens into the treatment channel and is intended for connection to a suction line. The suction line is connected to a collecting vessel for the recirculation of the spin finish fluid. An entrainment of excess spin finish fluid by the thread, which can result in contamination outside the apparatus, can thus be prevented advantageously.

In order to achieve firstly an advantageous air routing inside the treatment channel for interlacing the multifilament thread and secondly a natural slope for discharging the fluid residue accumulating in the treatment channel, that development of the invention is preferably used in which the groove ground of the treatment channel in the housing plate has an inclination directed toward the collector opening. The outlet opening of the treatment channel thus has a larger cross-section in relation to the inlet opening.

In order to achieve an advantageous air flow, which acts in the travel direction of the thread, in the treatment channel and in order to collect and discharge the spin finish fluid dripping off as a result of the deflection of the thread on the thread-guiding element, a preferred development of the invention provides the housing plate with a collector opening located opposite to the thread-guiding element. This collector opening is connected via a suction line to an external collecting vessel for receiving and depositing the fluid. It is thus possible to generate a suction power on the thread, which acts in the direction of the wetting device and further improves the wetting process by an intensive contact between the thread and the wetting element.

For protecting the contact surfaces of the housing plate and the baffle plate acting on the thread from wear, these contact surfaces can be formed by ceramic protective coatings. According to a preferred development of the invention, the housing plates and the baffle plate are made of a ceramic material for this purpose, the housing plate and the baffle plate also comprising plane-parallel sealing surfaces in addition to their contact surfaces; these sealing surfaces are held tightly on each other for sealing the treatment channel. The treatment channel can thus be provided with a seal for interlacing the thread without the use of any additional sealants.

For receiving the housing plate and the baffle plate, a preferred variant of the invention uses a support housing, in which the housing plate and the baffle plate are embedded. For this purpose, the support housing comprises a thread inlet and a thread outlet corresponding to the inlet opening and the outlet opening respectively.

For easy insertion of the thread into the treatment channel, the support housing preferably has a two-part design, one of the housing parts being formed as a swiveling housing cover, which carries the baffle plate on the lower side thereof. The treatment channel can thus be opened and closed easily by swiveling the housing cover without necessitating additional steps.

Since several threads are usually guided parallel to each other with a narrow spacing between the threads, one development of the invention is particularly suitable for the treatment of a plurality of threads. Here, a plurality of housing plates and a plurality of baffle plates are juxtaposed in the support housing.

In order to achieve the narrowest possible spacing between the threads, a plurality of treatment channels can be formed alternately in the housing plate and in the baffle plate, each treatment channel being provided with an assembly opening for receiving a wetting element and a collector opening for connection to a suction line.

BRIEF DESCRIPTION OF THE SEVERAL VIEWS OF THE DRAWINGS

The invention will be described in more detail below on the basis of several exemplary embodiments of the apparatus of the invention with reference to the attached drawings in which.

DETAILED DESCRIPTION

Figure 1:
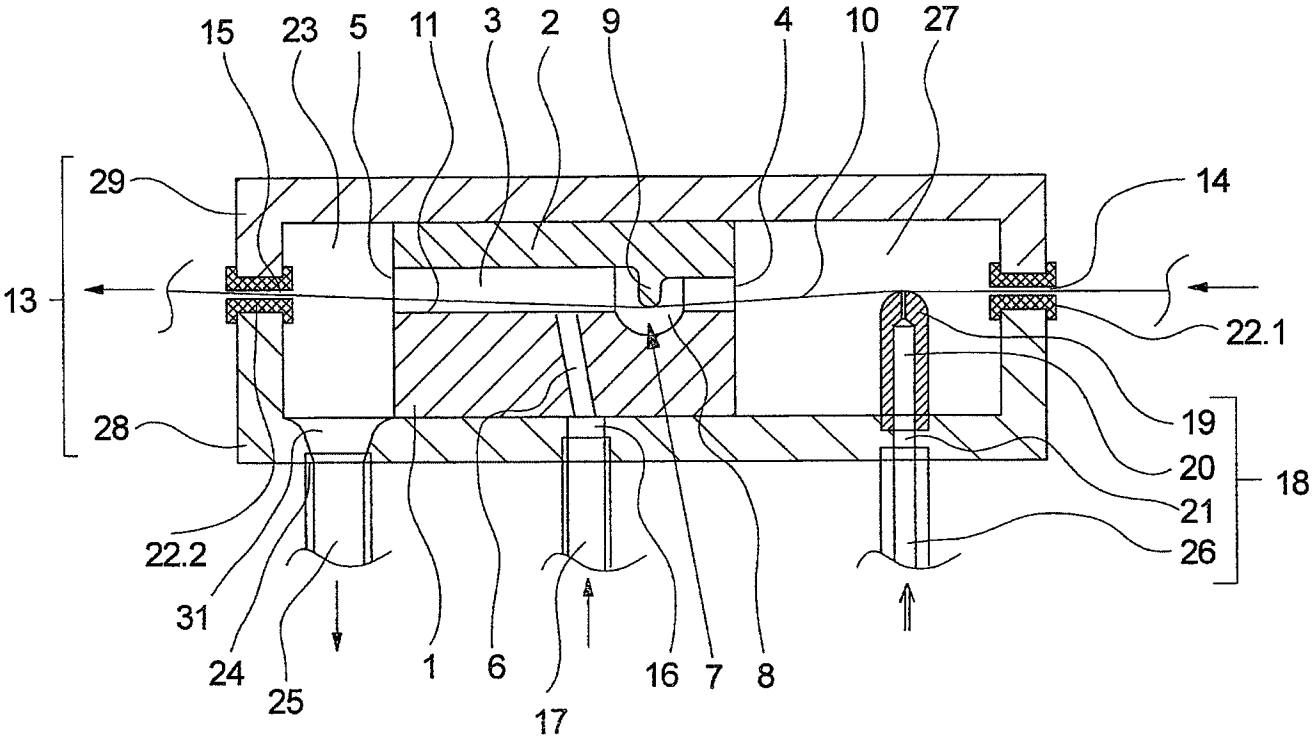
FIG. 1 schematically shows a view of the longitudinal section of a first exemplary embodiment of the apparatus of the invention FIG. 2 schematically shows a cross-sectional view of the exemplary embodiment shown in FIG. 1
Figure 2:
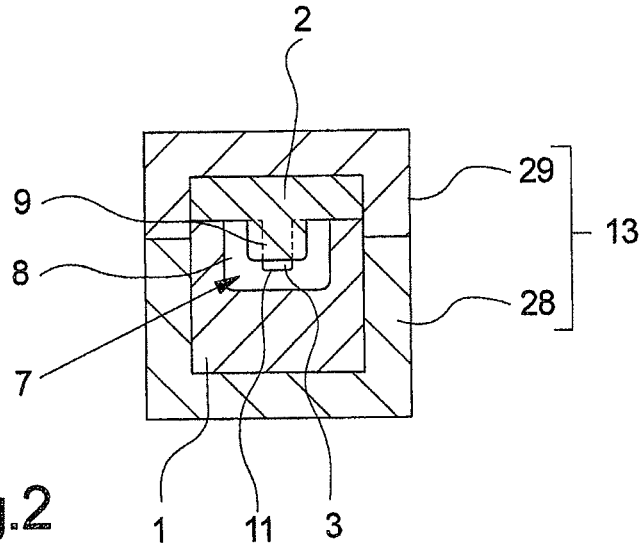

FIGS. 1 and 2 show a first exemplary embodiment of the apparatus of the invention for treating a multifilament thread.

FIG. 1 illustrates a view of the longitudinal section of the exemplary embodiment and FIG. 2 shows a cross-sectional view of the same. The following description applies to both figures unless express reference is made to any one of the figures.

In the exemplary embodiment shown in FIG. 1, a housing plate 1 and a baffle plate 2 are disposed inside a support housing 13. The open longitudinal side of the housing plate 1 comprises a treatment channel 3, which is formed as a groove on the longitudinal side of the housing plate 1. The treatment channel 3 is covered by the baffle plate 2 resting against the longitudinal side of the housing plate 1 so that the housing plate 1 and the baffle plate 2 form an inlet opening 4 and an outlet opening 5 in the extended treatment channel 3. A nozzle bore 6, which penetrates the housing plate 1 and is connected to a compressed-air supply 16 formed on the support housing 13, opens into the groove ground 11 of the treatment channel 3. The compressed-air supply 16 is coupled via a compressed-air line 17 to a compressed-air source (not illustrated here).

In that portion of the treatment channel 3 that is located between the inlet opening 4 and the nozzle bore 6, a thread-guiding element 7 is formed on the baffle plate 2, which protrudes into the treatment channel 3 for deflecting a thread 10 guided in the treatment channel 3. In this exemplary embodiment, the thread-guiding element 7 is formed by a projection 9 molded directly on the lower side of the baffle plate 2. The projection 9 has a shape that has been adapted to suit the treatment channel 3 so that the thread 10 is guided securely in the treatment channel 3. In the region of the thread-guiding element 7, the cross-section of the treatment channel 3 is extended by a recess 8. The recess 8 is shaped such that an extension of both the groove width and the groove depth of the treatment channel 3 are achieved.

In the exemplary embodiment shown in FIGS. 1 and 2, the projection 9 on the baffle plate 2 protrudes up to the groove ground 11 of the treatment channel 3 at a short distance from the same. Thus, the thread 10 is deflected easily at the projection 9 within the treatment channel 3. The contact surface of the projection 9 is preferably formed with a wear-resistant layer for this purpose.

As shown in FIG. 1, the support housing 13 forms a thread inlet 14 corresponding to the inlet opening 4, and a thread outlet 15 corresponding to the outlet opening 5 of the treatment channel 3. For this purpose, the support housing 13 is preferably formed by two parts 28 and 29 which are held together by sealing them in relation to the ambience. The housing parts 28 and 29 have recesses in the region of the thread inlet 14 and the thread outlet 15 in order to hold the respective thread guides 22.1 and 22.2 in position. Only in the region of the thread inlet 14 and the thread outlet 15, the thread guides 22.1 and 22.2 are held in the wall of the support housing 13. The thread guides 22.1 and 22.2 can be formed by ceramic elements by way of example.

In that region inside the support housing 13 that is located between the thread inlet 14 and the inlet opening 4, an inlet chamber 27 is formed in the extended treatment channel 3 for receiving a wetting device 18. The wetting device 18 comprises a spin finish applicator 19, which is held on the support housing 13 and comprises a fluid channel 20. The fluid channel 20 opens at a contact surface of the spin finish applicator 19. The opposite end of the fluid channel 20 is connected to a fluid connection 21. The fluid connection 21 is formed on the support housing 13 and is connected with the aid of a fluid line 26 to a fluid source (not illustrated here) for supplying a spin finish fluid, for example, an oil-in-water emulsion.

On the opposite side of the housing plate 1, an outlet chamber 23 is formed inside the support housing 13 in the extended treatment channel 3. The outlet chamber 23 is connected via a collector opening 31 in the wall of the support housing 13 to a suction connection 24. A suction line 25, which is coupled to a collecting vessel via a vacuum source (not illustrated here), is connected to the suction connection 24.

In the exemplary embodiment of the apparatus of the invention shown in FIGS. 1 and 2, a multifilament thread formed by a plurality of individual restiform filaments, is supplied for treatment via the thread inlet 14. Inside the support housing 13, the filaments of the thread 10 are initially wetted at the spin finish applicator 19 formed as the wetting element. For this purpose, the filaments of the thread 10 are guided such that they contact the wetted surface of the spin finish applicator 19 and are wetted uniformly with a spin finish fluid.

The wetted thread 10 is then supplied via the inlet opening 4 to the treatment channel 3. The filaments of the thread 10 are interlaced by the compressed-air blast discharged into the treatment channel 3 by way of the nozzle bore 6. The compressed-air blast is preferably adjusted such that it results in a mere mixing of the filaments without forming knots and in particular in a homogenization of the spin finish fluid application on the thread. The dynamic effects produced by the compressed-air blast on the thread, in particular, the twist effects are prevented from acting on the thread in the direction extending opposite to the thread travel direction by deflecting the thread 10 at the projection 9 of the baffle plate 2, which projection protrudes into the treatment channel 3. The dynamic effects generated by the interlacing of the filaments of the thread 10 advantageously remain in the treatment channel and cannot act uncontrollably on the thread in the direction extending opposite to the thread travel direction.

The deflection of the thread 10 in the direction of the groove ground 11, which deflection is produced in the treatment channel 3 by the baffle plate 2, additionally improves the thread guidance and the interlacing of the thread. The projection 9 of the baffle plate 2 deflects the thread 10 in the treatment channel 3 opposite to the flow direction of the compressed air supplied. The baffle plate 2 is connected to the housing plate 1 for replacement so that the magnitude of deflection of the thread in the treatment channel can be altered by replacing the baffle plate 2. A plurality of baffle plates 2 having varying projections 9 can thus be kept ready in order to be combined selectively with the housing plate 1 in the support housing 13. The housing plate 1 is likewise held preferably for replacement in the support housing 13 so that a housing plate 1 comprising a larger or smaller nozzle bore 6 can be used, for example. The interlacing process can thus be adjusted to suit the respective thread type. The nozzle bore 6 preferably opens at an inclination directed in the travel direction of the thread so that a compressed-air blast that is directed toward the outlet opening 5 can be produced in the treatment channel 3. Furthermore, excess residue of the spin finish fluid can be guided by way of the treatment channel 3 toward the outlet chamber 23. Inside the outlet chamber 23, the residue of the spin finish fluid is discharged by way of the collector opening 31. For this purpose, a slight vacuum is produced in the outlet chamber 23.

After the thread 10 is wetted and interlaced, it is guided out of the support housing 13 by way of the thread outlet 15.

The exemplary embodiment shown in FIGS. 1 and 2 serves as an example of the selection and arrangement of individual parts of the apparatus of the invention. In principle, the wetting device 18 can be formed by other wetting elements such as nozzles or rollers, for example. Likewise, the thread-guiding element 7 provided on the baffle plate 3 and shaped as a molded projection 9 is an example of the various designs possible.

Figure 4:
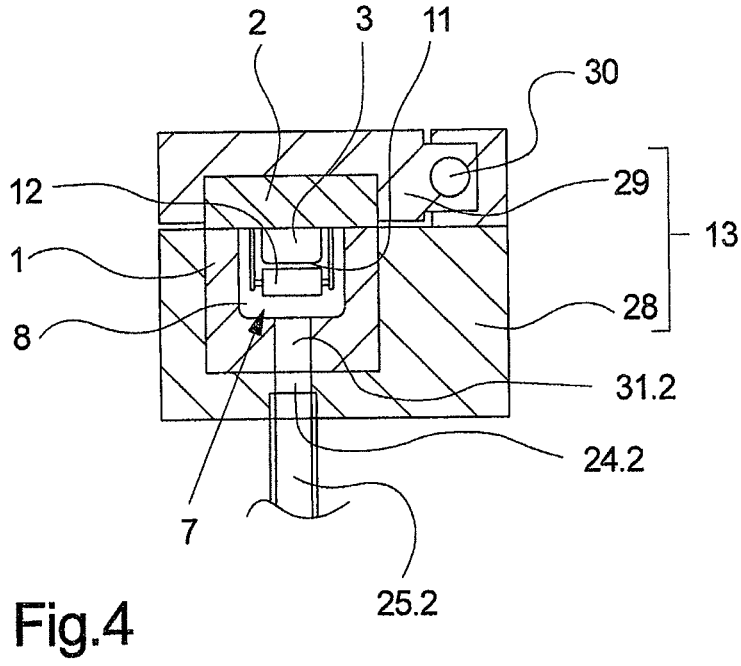
Figure 3:
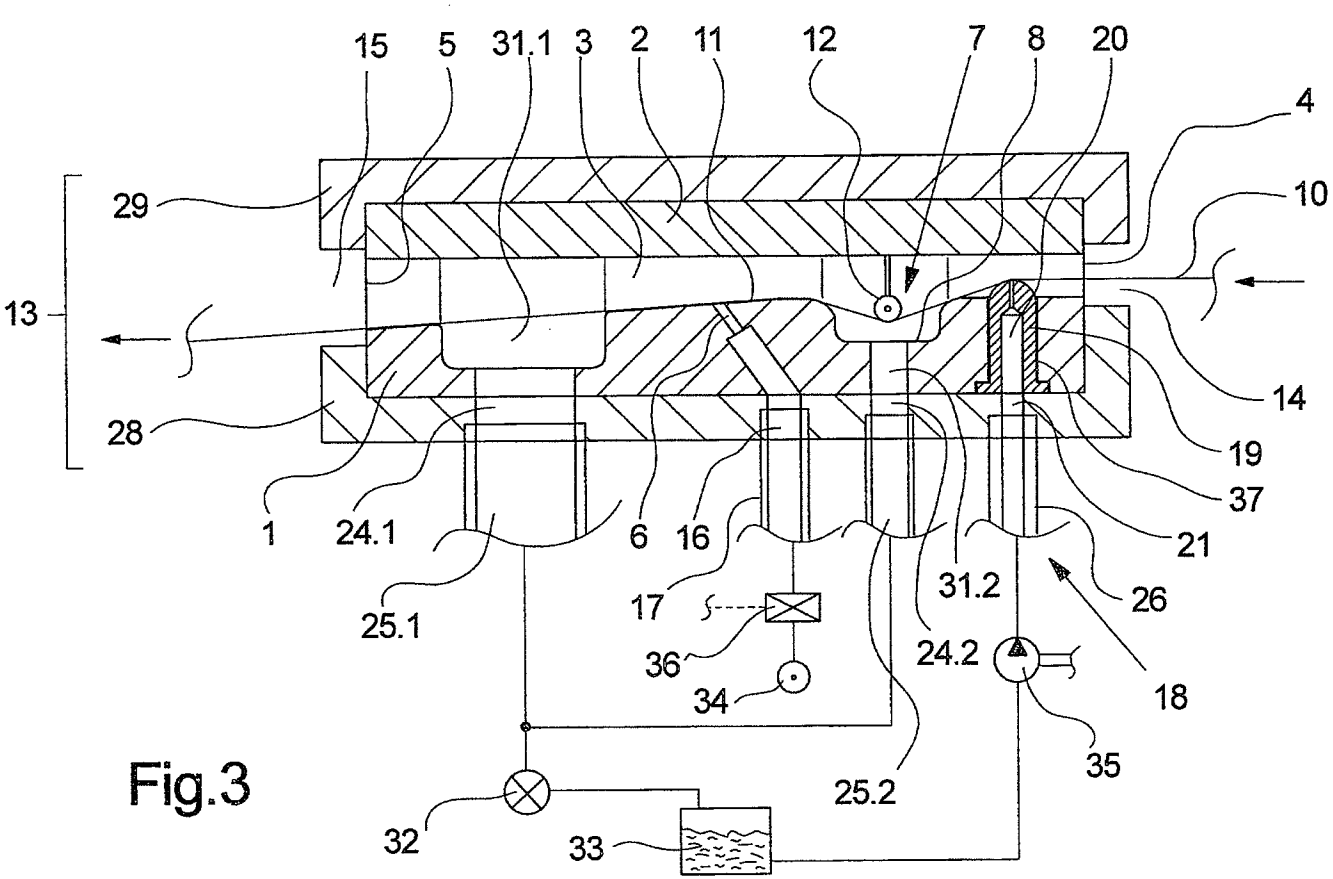
FIG. 3 schematically shows a view of the longitudinal section of another exemplary embodiment of the apparatus of the invention FIG. 4 schematically shows a cross-sectional view of the exemplary embodiment shown in FIG. 3
Figure 5:
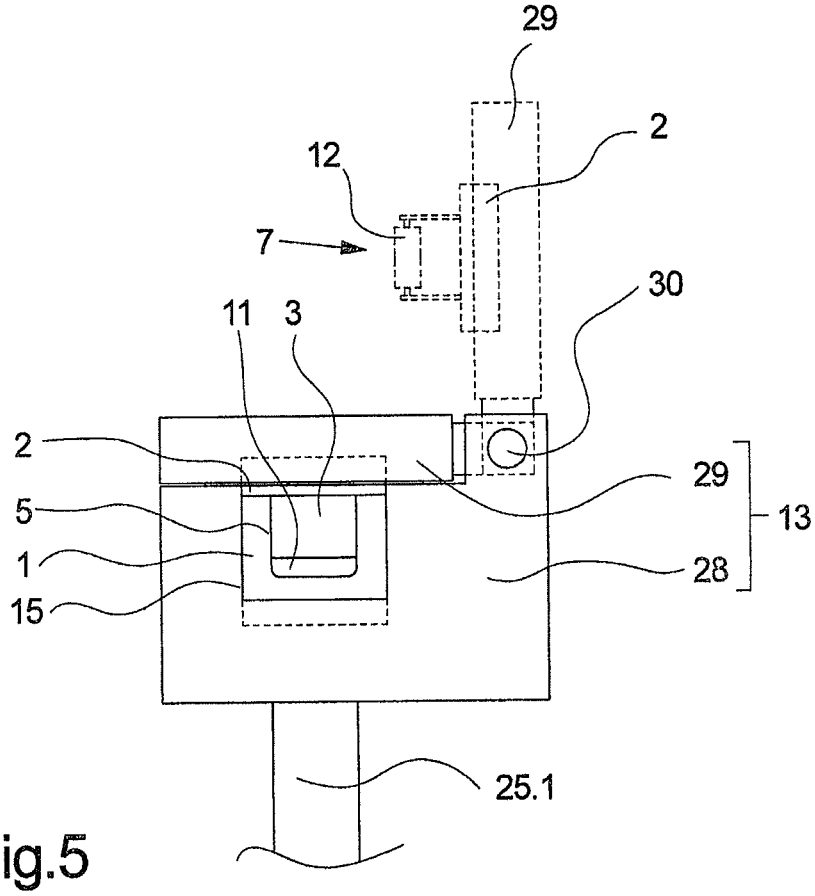
FIG. 5 schematically shows a side view of the exemplary embodiment shown in FIG. 3

FIGS. 3, 4 and 5 show another exemplary embodiment of the apparatus of the invention used preferably in a melt-spinning process for producing a plurality of synthetic threads. FIG. 3 is a schematic view of the longitudinal section of the exemplary embodiment, FIG. 4 is a cross-sectional view thereof and FIG. 5 is a side view thereof. The following description applies to all the figures unless express reference is made to any one of the figures.

Those apparatus parts of the exemplary embodiment that have identical functions have the same reference numerals.

In the exemplary embodiment shown in FIGS. 3, 4 and 5, a housing plate 1 and a baffle plate 2 are embedded in a support housing 13. The support housing 13 is provided with a two-part design comprising a housing base 28 and a housing cover 29. The housing cover 29 is held on the upper side of the housing base 28 such that the former can swivel about a swivel axis 30. The baffle plate 2 and the housing plate 1 are attached for replacement to the housing cover 29 and the housing base 28 respectively. The baffle plate 2 and the housing plate 1 are thus separated from each other by opening and closing the housing cover 29. When the housing cover 29 is opened, a thread can be inserted into a treatment channel 3 formed on the longitudinal side of the housing plate 1. This situation is shown using dashed lines in the side view in FIG. 5.

After the insertion of a thread into the treatment channel 3, the housing cover 29 is closed with the baffle plate 2 so that the sealing surfaces of the housing plate 1 and the baffle plate 2 are held on each other forming a seal. The sealing surfaces of the housing plate 1 and the baffle plate 2 extend along the treatment channel 3 so that the latter is sealed in relation to the ambience. In this case, there is no requirement of creating a seal between the housing parts 28 and 29.

As is apparent from the illustration of FIG. 3, in particular, the baffle plate 2 and the housing plate 1 form the treatment channel 3, an inlet opening 4 and an outlet opening 5 being formed on each of the front sides. Corresponding to the inlet opening 4 and the outlet opening 5, a thread inlet 14 and a thread outlet 15 are formed between the housing cover 29 and the housing base 28.

The housing plate 1 and the baffle plate 2 are substantially identical to the ones used in the exemplary embodiment described above so that only the differences will be explained below and otherwise reference is made to the above description.

As opposed to the exemplary embodiment shown in FIG. 1, the wetting device 18 in the exemplary embodiment shown in FIG. 3 is connected to the housing plate 1. For this purpose, the housing plate 1 comprises an assembly opening 37 in that portion of the treatment channel 3 that is located between the recess 8 and the inlet opening 4, in which a wetting element 19 of the wetting device 18 is held. The wetting element is formed by a spin finish applicator 19 that is connected to the housing plate 1 for replacement. The spin finish applicator 19 protrudes from the assembly opening 37 into the treatment channel 3 and forms a wetted contact surface inside the treatment channel 3, and the thread 10 comes into contact with this contact surface. The spin finish applicator 19 is connected with the aid of a fluid channel 20 to a fluid connection 21 on the housing base 28. The fluid channel 20 opens at the contact surface of the spin finish applicator 19 inside the treatment channel 3.

A thread-guiding element 7, which is attached to the baffle plate 2 and which is inserted into the treatment channel 3 and the recess 8, is disposed downstream of the spin finish applicator 19 in the travel direction of the thread.

As is apparent from FIGS. 3 and 4, the thread-guiding element 7 in this exemplary embodiment is formed by a replaceable thread guide, in this case a deflection roller 12. The deflection roller 12 is held, preferably for replacement, on the lower side of the baffle plate 2. The deflection roller 12 protrudes beyond the groove ground 11 of the treatment channel 3 into the recess 8 so that the thread 10 inside the treatment channel 3 is deflected beyond the groove depth of the treatment channel 3. Additional points of support, which are intended for supporting the thread 10 and result in an intensive stabilization of the interlaced thread, can thus be implemented advantageously in the transition sections between the recess 8 and the treatment channel 3.

A nozzle bore 6, which penetrates the housing plate 1 and is connected to a compressed-air supply 16 on the housing base 28, opens into the treatment channel 3 in the central portion of the housing plate 1.

In the further course of the treatment channel 3, a collector opening 31.1, which penetrates the housing plate 1 and is coupled to a suction connection 24.1 provided in the housing base 28, is formed in the housing plate 1 in that portion of the treatment channel that is located between the nozzle bore 6 and the outlet opening 5. The collector opening 31.1 results in an extension of the treatment channel 3 both in terms of its width and depth. The groove ground 11 of the treatment channel 3 in the housing plate 1 has an inclination directed toward the collector opening 31.1 so, that there results a natural slope toward the outlet opening 5. The outlet opening 5 therefore has a larger cross-section than the opposite inlet opening 4. This design of the treatment channel 3 has proved useful both for the discharge of excess fluid residue and for creating the interlacing effects on the thread.

Particularly in order to be able to discharge the residue of the spin finish fluid dripping down as a result of a deflection of the thread 10 from the treatment channel 3, a second collector opening 31.2 penetrating the housing plate 1 is formed in the ground of the recess 8. The collector opening 31.2 is connected to a suction line 25.2 in the housing base 28.

For discharging the residue of spin finish fluid accumulating inside the treatment channel 3, suction lines 25.1 and 25.2 are connected via a vacuum source 32 to a collecting vessel 33 so that the fluid residue is recirculated continuously to the collecting vessel 33. In this connection, additional steps such as a processing step for the spin finish fluid can also be interposed, to advantage.

The functioning of the exemplary embodiment shown in FIG. 3 to FIG. 5 is identical to the one shown in FIGS. 1 and 2. Reference is made at this point to the above description. Additionally, FIG. 3 shows a connection option for the supply and discharge of a spin finish fluid and for the supply of compressed air to the apparatus of the invention. Thus, the spin finish fluid is supplied to the spin finish applicator 19 from a dosing pump 35 by way of the fluid line 26. For this purpose, the dosing pump 35 is connected to the collecting vessel 33 which maintains a supply of a spin finish fluid such as an oil-in-water emulsion for wetting a synthetic thread.

For feeding compressed air into the nozzle bore 6, a pressure source 34 is provided, which is connected via a control valve 36 and the compressed-air line 17 to the nozzle bore 6. The control valve 36 enables the selection of the desired pressure settings for producing the compressed-air blasts entering the treatment channel 3.

Figure 6:
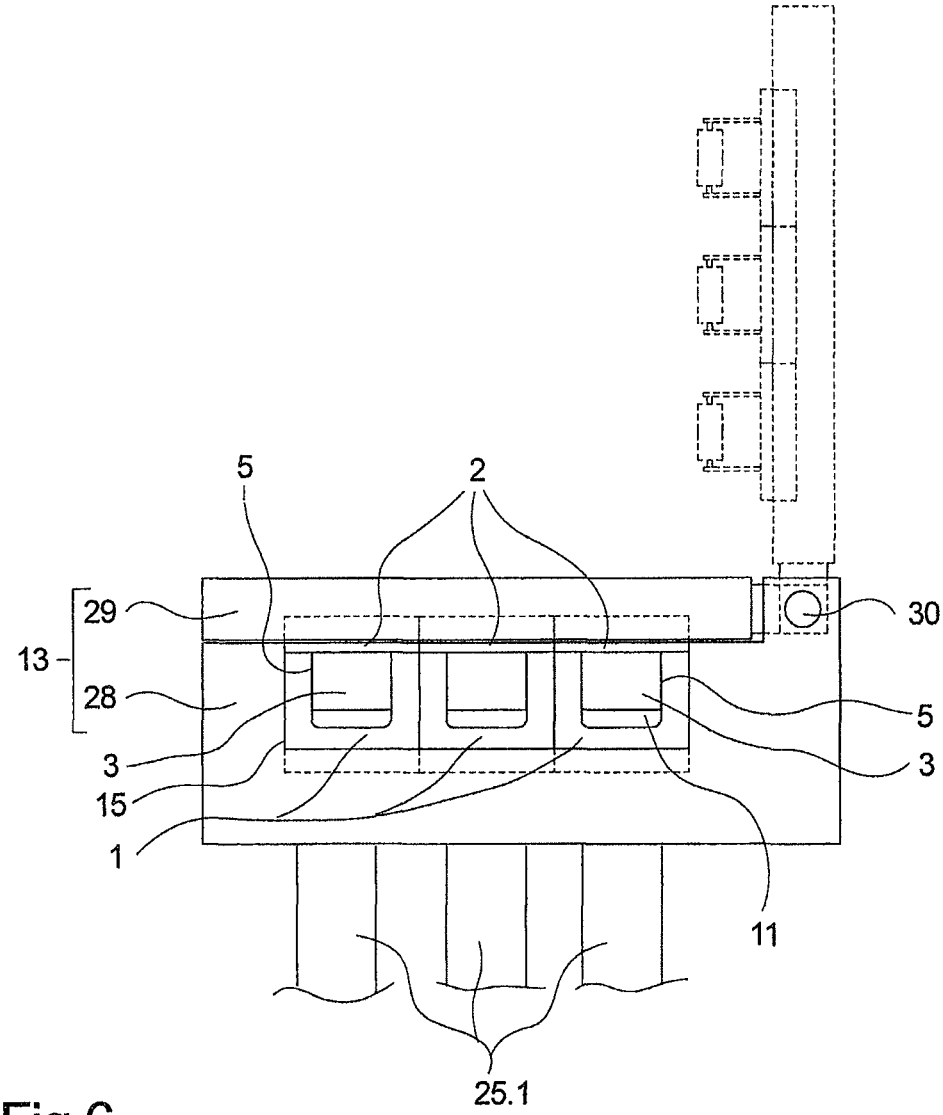
FIG. 6 schematically shows a side view of another exemplary embodiment of the apparatus of the invention

The exemplary embodiments shown in FIGS. 1 to 5 are preferably suitable for continuously wetting and interlacing each individual thread. However, several threads are usually produced parallel to each other in melt-spinning processes so that several devices have to be arranged side-by-side in order to wet and interlace the threads in parallel. In order to be able to achieve the least possible spacing between the threads, another exemplary embodiment of the apparatus according to the invention is shown in FIG. 6. FIG. 6 shows a side view of the exemplary embodiment.

Here, a plurality of housing plates 1 and a plurality of baffle plates 2 are held directly next to each other inside a support housing 13. In the exemplary embodiment, a total of three housing plates 1 and three baffle plates 2 are shown which are in contact with each other and are disposed side-by-side in a row. The designs of the housing plate 1 and the baffle plate 2 are identical to those used in the exemplary embodiment shown in FIGS. 3 and 4 so that reference is made to the above description in order to avoid repetition. The adjacent housing plates 1 and the adjacent baffle plates 2 can be disposed both parallel to each other—as shown in FIG. 6—or at an angle to each other.

In this exemplary embodiment, a housing base 28 and a housing cover 29 that are connected to each other over a swivel axis 30 likewise form the support housing 13. The housing cover 29 carries a total of three baffle plates 2 on the lower side thereof so that three threads can be inserted simultaneously into the treatment channels 3 of the housing plates 1 in an open position of the housing cover 29. The apparatus shown in FIG. 6 is particularly suitable to wet and interlace a beer in parallel.

Alternately, the treatment channels 3 illustrated in FIG. 6 can each be formed by a housing plate and a baffle plate. For this purpose, the housing plate 1 would comprise a plurality of treatment channels 3, which are located parallel to each other and can be closed by a baffle plate, and three thread-guiding elements assigned to the treatment channels would be held on the baffle plate.

The invention claimed is:

1. An apparatus for treating a multifilament thread in a melt-spinning process, comprising:

a housing plate, which comprises a treatment channel on an open longitudinal side thereof and a nozzle bore, which opens into the treatment channel and which penetrates the housing plate for being connected to a compressed-air supply; and a baffle plate, which delimits the treatment channel at the longitudinal side of the housing plate and which together with the housing plate forms an inlet opening and an outlet opening at the ends of the treatment channel, wherein the baffle plate comprises a thread-guiding element in that portion of the treatment channel that is located between the nozzle bore and the inlet opening, which is configured so as to protrude into the treatment channel in order to deflect the thread.

2. The apparatus according to claim 1, wherein the housing plate comprises a recess in the region of the thread-guiding element for extending the treatment channel, through which the thread-guiding element can be inserted beyond the groove ground of the treatment channel.

3. The apparatus according to claim 1, wherein the thread-guiding element is formed by a molded projection on the baffle plate, which comprises a wear-resistant contact surface in relation to the thread.

4. The apparatus according to claim 3, wherein the baffle plate is connected to the housing plate such that the former can be replaced, it being possible to selectively combine several baffle plates having variably high projections with the housing plate.

5. The apparatus according to claim 1, wherein the thread-guiding element is formed by a thread guide, which is held at the baffle plate such that the thread guide can be replaced.

6. The apparatus according to claim 5, wherein the thread guide is formed by a deflection pin or a deflection roller and wherein the deflection pin or the deflection roller comprises a wear-resistant contact surface for guiding the thread.

7. The apparatus according to claim 1, wherein in that portion of the treatment channel that is located between the thread-guiding element and the inlet opening, the housing plate comprises an assembly opening for connection to a wetting device, a wetting element being held so as to protrude into the treatment channel for wetting the thread.

8. The apparatus according to claim 7, wherein the wetting element is connected to the housing plate such that the former can be replaced.

9. The apparatus according to claim 7, wherein the wetting element is formed by a spin finish applicator, which comprises a ceramic contact surface in the guide area of the thread.

10. The apparatus according to claim 7, wherein in that portion of the treatment channel that is located between the nozzle bore and the outlet opening, the housing plate comprises a collector opening, which opens into the treatment channel, for connection to a suction line, the suction line being connected to a collecting vessel for the recirculation of a wetting agent.

11. The apparatus according to claim 10, wherein the groove ground of the treatment channel in the housing plate has an inclination directed toward the collector opening.

12. The apparatus according to claim 7, wherein a second collector opening located opposite to the thread-guiding element is formed in the housing plate, which is connected via a suction line to the collecting vessel.

13. The apparatus according to claim 1, wherein the housing plate and the baffle plate are made of a ceramic material and their contact surfaces are held tightly on each other for sealing the treatment channel.

14. The apparatus according to claim 1, wherein the housing plate and the baffle plate are disposed in a support housing and wherein the support housing comprises a thread inlet and a thread outlet corresponding to the inlet opening and the outlet opening respectively.

15. The apparatus according to claim 14, wherein the support housing has a two-part design, one of the housing parts being formed as a swiveling housing cover, which carries the baffle plate on the lower side thereof.

16. The apparatus according to claim 14, wherein the support housing is configured to receive a plurality of housing plates and a plurality of baffle plates.

* * * * *